United States Patent [19]

Ehrlich

[11] 4,026,254

[45] May 31, 1977

[54] TWO STROKE INTERNAL COMBUSTION ENGINE AND METHOD OF OPERATION THEREOF

[75] Inventor: Josef Ehrlich, Ashridge near Berkhamsted, England

[73] Assignee: Outboard Marine Corporation, Waukegan, Ill.

[22] Filed: May 22, 1975

[21] Appl. No.: 579,808

[52] U.S. Cl. ..... 123/73 AA; 123/65 R; 123/73 R; 123/73 PP

[51] Int. Cl.[2] ..... F02B 33/04

[58] Field of Search ..... 123/65 R, 65 WV, 69 R, 123/71 R, 73 R, 73 A, 73 AA, 73 C, 73 CC, 73 PP, 74 R, 26

[56] References Cited

UNITED STATES PATENTS

| | | | |
|---|---|---|---|
| 968,200 | 8/1910 | Scott | 123/73 A |
| 2,966,900 | 1/1961 | Ehrlich | 123/73 PP |
| 3,312,205 | 4/1967 | Ehrlich | 123/74 R |

*Primary Examiner*—C. J. Husar
*Assistant Examiner*—David D. Reynolds
*Attorney, Agent, or Firm*—Michael, Best & Friedrich

[57] ABSTRACT

Disclosed herein is an internal combustion engine (and a method of operation thereof) comprising a piston movable relative to a combustion chamber and to a crankcase to effect cyclical pressure variation in the crankcase in response to piston movement, a transfer passage for introducing fuel-air mixture into the combustion chamber from the crankcase in response to cyclical crankcase pressure variation, an auxiliary chamber separate from the transfer passage, and a port arrangement for providing the auxiliary chamber with pressurized air in response to cyclical crankcase pressure variation and for initiating communication of the auxiliary chamber with the combustion chamber in response to piston movement during the presence of pressurized air in the auxiliary chamber and at a time other than the time of initiation of introduction of fuel-air mixture into the combustion chamber.

33 Claims, 6 Drawing Figures

Fig. 1
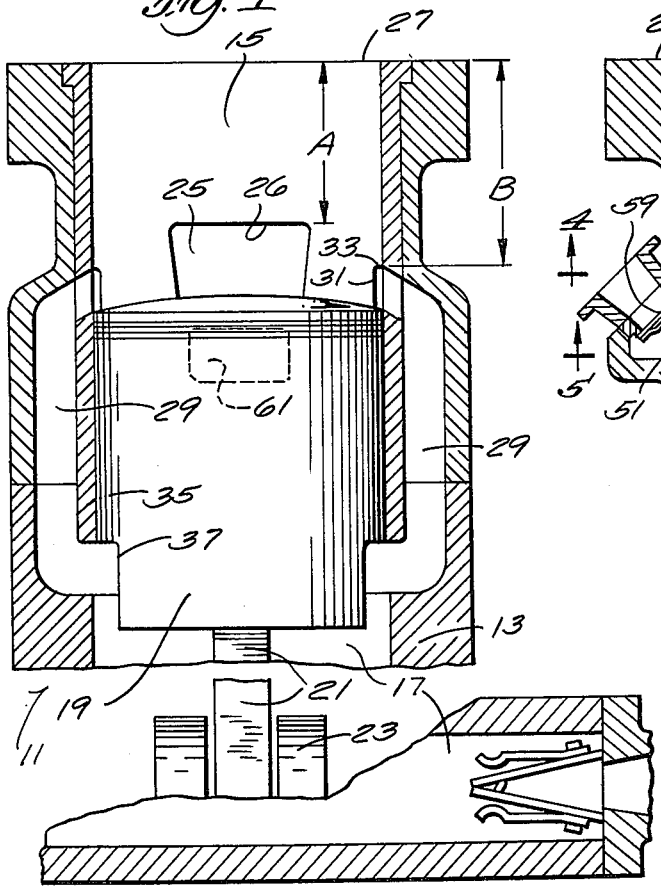
Fig. 2
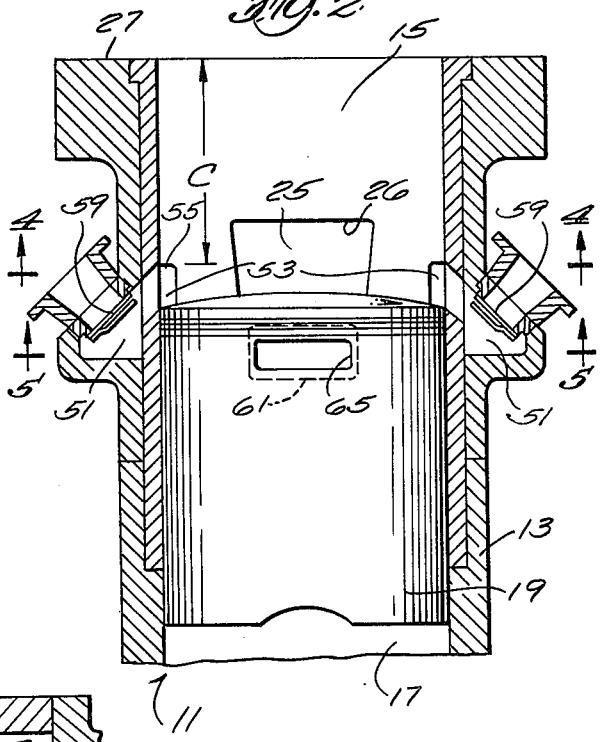
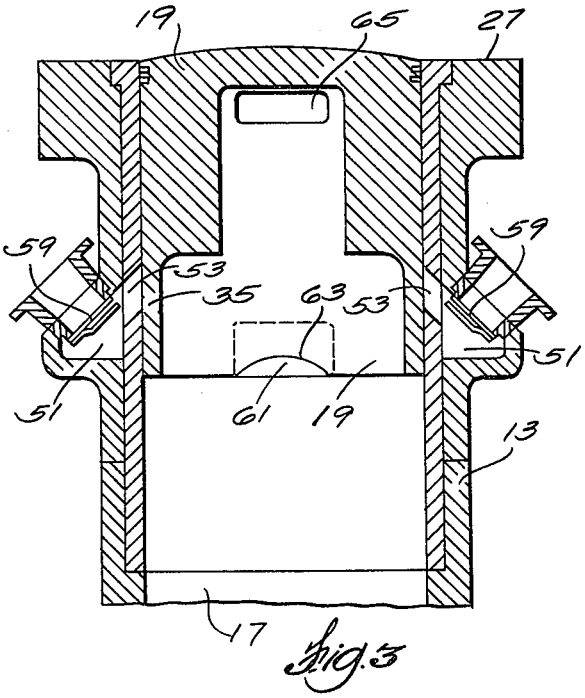
Fig. 3
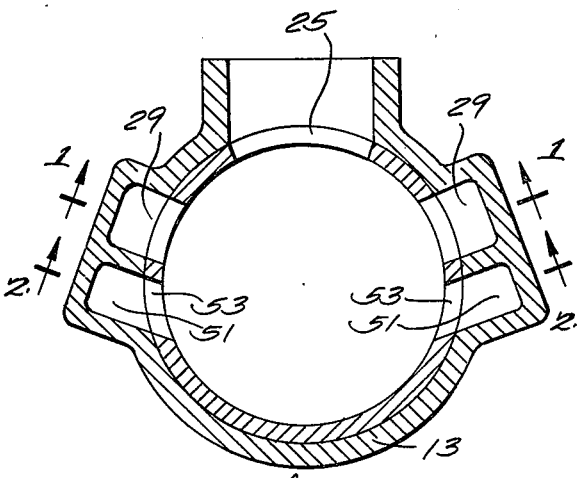
Fig. 4

TWO STROKE INTERNAL COMBUSTION ENGINE AND METHOD OF OPERATION THEREOF

BACKGROUND OF INVENTION

The invention relates generally to internal combustion engines, and more particularly, to two-stroke pistonported engines. Such engines have, in the past, commonly employed the incoming fuel-air mixture to scavenge the exhaust gases from the cylinder with the result that incoming charge was often, in part, discharged unburnt through the exhaust system into the atmosphere, thereby providing a polution problem as well as adversely affecting fuel economy.

Disclosed in the U.S. Scott Pat. No. 968,200 issued Aug. 23, 1910, and in the U.S. Springer Pat. No. 980,134 issued Dec. 27, 1910, are two stroke internal combustion engines in which scavenging air is sucked into a transfer passage and delivered from the transfer passage into the cylinder ahead of delivery of fuel-air mixture through the transfer passage from the crankcase.

Attention is also directed to the following U.S. patents which disclose delivery of scavenging air to the cylinder prior to delivery to the cylinder of fuel-air mixture.

| Patent | | Issue Date |
|---|---|---|
| Brehm | 854,981 | May 28, 1907 |
| Easthope | 976,858 | November 29, 1910 |
| Bachle & Krebs | 1,115,481 | November 3, 1914 |
| Deacon | 1,511,112 | October 7, 1924 |
| Mansoff | 2,381,832 | August 7, 1945 |

Attention is also directed to my earlier U.S. Pat. No, 3,312,205 issued April, 1967 and U.S. Pat. No. 2,966,900 issued Jan. 3, 1961, which disclose other forms of prior two-stroke internal combustion engines.

SUMMARY OF THE INVENTION

The invention provides an internal combustion engine comprising a combustion chamber, a crankcase, a piston movable relative to the combustion chamber and the crankcase to effect cyclical pressure variation in the crankcase in response to piston movement, means including a transfer passage for introducing fuel-air mixture into the combustion chamber from the crankcase in response to cyclical crankcase pressure variation, an auxiliary chamber separate from the transfer passage, means for providing the auxiliary chamber with pressurized air in response to cyclical crankcase pressure variation, and means for initiating communication of the auxiliary chamber with the combustion chamber in response to piston movement during the presence of pressurized air in the auxiliary chamber and at a time other than the time of initiation of introduction of fuel-air mixture into the combustion chamber.

In accordance with an embodiment of the invention, the means for initiating communication of the auxiliary chamber with the combustion chamber includes means for initiating communication between the combustion chamber and the auxiliary chamber prior to introduction of fuel-air mixture into the combustion chamber.

In accordance with an embodiment of the invention, the means for providing the auxiliary chamber with pressurized air comprises means for initially introducing air into the auxiliary chamber and for subsequently pressurizing the air in the auxiliary chamber. More specifically, the means for introducing and pressurizing air in the chamber includes means for selectively communicating the auxiliary chamber with the crankcase.

In accordance with one embodiment of the invention, there is provided an internal combustion engine comprising a transfer passage communicating between the crankcase and the cylinder in response to piston movement during conditions of relatively high pressure in the crankcase so as to thereby introduce fuel-air mixture into the cylinder from the crankcase, chamber means separate from the transfer passage, means for introducing air into the chamber means during conditions of relatively low pressure therein, and means operable in response to piston movement for selectively communicating the chamber means with the crankcase and with the cylinder so as to first subject the chamber means to relatively low pressure by communicating the chamber means to the crankcase during a condition of relatively low pressure in the crankcase, to thereafter isolate the chamber means from the crankcase by discontinuing communication between the chamber means and the crankcase, and thereafter to subject the chamber means to relatively high pressure by communicating the chamber means to the crankcase during a condition of relatively high pressure in the crankcase, and to initiate communication of the chamber means with the cylinder when the chamber means is subject to relatively high presure and at a time other than the time of initiation of introduction of fuel-air mixture into the cylinder from the crankcase.

In one embodiment in accordance with the preceding paragraph, the means for communicating the chamber means with the cylinder includes means for initiating communication between the cylinder and the chamber means prior to introduction of fuel-air mixture into the cylinder.

In one embodiment in accordance with the preceding paragraphs, the means for communicating the chamber means with the crankcase during a condition of relatively high pressure in the crankcase comprises a port in the piston providing communication between the crankcase and the chamber means.

In accordance with an embodiment of the invention, there is also provided an internal combustion engine comprising an engine block including a cylinder having a head end, a crankcase extending from the end of the cylinder remote from the head end, an exhaust port communicating with the cylinder and having an upper edge located at a given distance from the cylinder head end, a chamber including a first port communicable with the cylinder and having an upper edge located at a given distance from the cylinder head end greater than the distance from the exhaust port upper edge to the cylinder head end, which chamber also includes a second port communicable with the crankcase and including an upper edge located at a given distance from the cylinder head end greater than the distance from the first chamber port upper edge to the cylinder head end, and a transfer passage communicating with the crankcase and including a transfer port communicable with the cylinder and having an upper edge located at a given distance from the cylinder head end greater than the distance from the chamber first port upper edge to the cylinder head end, and a piston including a skirt having therein a port, which piston is reciprocable relative to the cylinder and to the crankcase so as to cyclically produce in the crankcase conditions of relatively high and low pressure, and so as, when the piston is adjacent to the cylinder head end, to close the exhaust port from the cylinder, to close the first chamber port from the cylinder, to close the transfer port from the cylinder, and to open the second chamber port to the crankcase during a condition of relatively low pressure therein, and so as, during piston travel from the cylinder head end, to close the second chamber port from the crankcase and thereby to isolate the chamber from the cylinder and the crankcase, to thereafter open the port to the cylinder and to communicate the chamber second port through the piston port to the crankcase during a condition of relatively high pressure therein, to thereafter open the chamber first port to the cylinder, and to thereafter open the transfer port to the cylinder.

The invention also provides a method of operating an internal combustion engine including the steps of supplying a fuel-air mixture to a crankcase during a condition of relatively low pressure in the crankcase, introducing air into a chamber separate from a transfer passage in response to establishing communication between the chamber and the crankcase during a condition of relatively low pressure in the crankcase, thereafter isolating the chamber from the crankcase by discontinuing communication between the chamber and the crankcase, and thereafter pressurizing the air in the chamber in response to establishing communication between the chamber and the crankcase during a condition of relatively high pressure in the crankcase, introducing the fuel-air mixture into a cylinder from the crankcase by establishing communication between the transfer passage and the cylinder during a condition of relatively high pressure in the crankcase, and introducing the pressurized air into the cylinder from the chamber by establishing communication between the chamber and the cylinder such that communication between the cylinder and the chamber is initiated at a time other than the time of initiation of introduction of fuel-air mixture into the cylinder.

In accordance with an embodiment of the invention, the step of introducing air into the cylinder from the chamber is initiated before the step of introducing fuel-air mixture into the cylinder is initiated.

In accordance with an embodiment of the invention, the step of pressurizing the air occurs prior to initiation of communication between the cylinder and the chamber.

In accordance with an embodiment of the invention, the step of pressurizing the air occurs incident to establishing communication through the piston between the crankcase and the chamber.

One of the principal features of the invention is the provision of a two stroke internal combustion engine and method of operation thereof which provides the dual advantages of reducing polution and increasing horsepower output.

Other features of the embodiments of the invention will become known by reference to the following drawings, general description, and claims.

THE DRAWINGS

FIG. 1 is a fragmentary and partially schematic, cross sectional view, taken generally along line 1—1 of FIG. 4, of one embodiment of an internal combustion engine which incorporates various of the features of the invention and which is shown with the piston adjacent bottom dead center.

FIG. 2 is a fragmentary cross sectional view, taken generally along line 2—2 of FIG. 4 of the internal combustion engine which is shown in FIG. 1.

FIG. 3 is a fragmentary cross sectional view similar to FIG. 2 with the piston shown at top dead center position.

FIG. 4 is a cross sectional view taken along line 4—4 of FIG. 2 and with the piston omitted.

Figure 5:
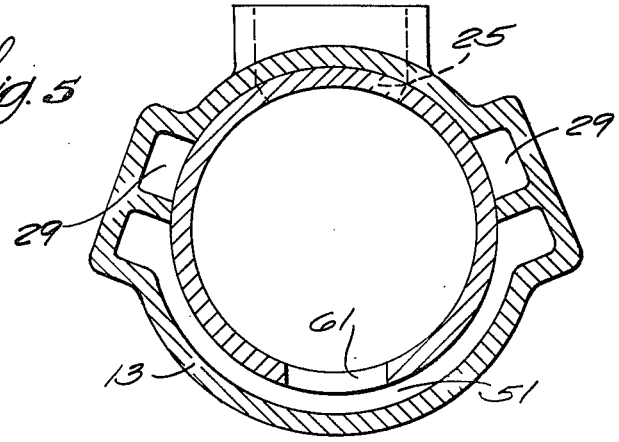
FIG. 5 is a cross sectional view taken along line 5—5 of FIG. 2 and with the piston omitted.

Before explaining the embodiments of the invention in detail, it is to be understood that the invention is not limited in its application to the details of construction and the arrangement of the components set forth in the following description or illustrated in the drawings. The invention is capable of other embodiments and of being practiced and carried out in various ways. Also it is to be understood that the phraseology and terminology employed herein is for purposes of description and should not be regarded as limiting.

GENERAL DESCRIPTION

Shown in the drawings is an internal combustion engine 11 which incorporates various of the features of the invention. More specifically, the engine 11 includes a block 13 defining a combustion chamber 15 in the form of a cylinder, and a crankcase 17 extending from the combustion chamber 15. Reciprocably movable in the combustion chamber 15 is a piston 19 which cyclically produces conditions of relatively high and low pressures in the combustion chamber 15 and in the crankcase 17 incident to such reciprocation.

The piston 19 is connected in the usual way to a connecting rod 21 which, in turn, is connected to a crankshaft 23 extending through the crankcase 17.

In accordance with usual practice, the combustion chamber 15 communicates with an exhaust port 25 which extends through the block 13 and includes an upper edge 26 spaced from the cylinder head end 27 at a distance "A" such that the exhaust port 25 is opened as the piston 19 travels from top dead center to bottom dead center.

Also in accordance with the usual practice, the combustion chamber 15 and crankcase 17 are placed in communication with each other in response to piston movement after opening of the exhaust port 25 as the piston travels toward bottom dead center and when the pressure in the crankcase is approximately maximum. Such communication is provided by one or more (two in the illustrated construction) transfer passages 29 which are utilized to effect flow of the fuel-air mixture from the crankcase 17 into the combustion chamber. Fuel-air mixture can be introduced into the crankcase 17 in response to pressure variation therein in any known manner.

In the illustrated construction, the transfer passage 29 extend in the engine block 13 and are open to both the combustion chamber 15 and the crankcase 17 when the piston 19 is at bottom dead center. In this last regard, the transfer passages 29 communicate with the combustion chamber 15 through transfer ports 31 having upper edges 33 spaced from the cylinder head end 27 at a distance "B" which is greater than the distance "A" Preferably, the crankcase 17 is in continuous communication with the transfer passages 29. In this regard, the piston 19 includes a skirt 35 which can include, along the lower edge thereof, notches 37 providing communication between the transfer passages 29 and the crankcase 17.

Means separate from the transfer passage 29, but operable in response to cyclical crankcase pressure, are provided for introducing air, as distinguished from fuel-air mixture, into the combustion chamber 15 at a time other than the time of initiation of communication through the transfer passage 29 between the combustion chamber 15 and the crankcase 17. Preferably, the air is introduced into the combustion chamber 15 subsequent to opening of the exhaust port 25 and prior to initial introduction of fuel-air mixture into the combustion chamber 15 incident to initiation of communication between the transfer passages 29 and the combustion chamber 15. Such prior introduction of air serves the dual purpose of assisting in scavenging and of supplying air to the exhaust system which can be used for combustion therein of any unburnt fuel. Such prior introduction of air also serves to minimize loss of unburnt fuel-air mixture through the exhaust port. However, the invention is not limited to introduction of air prior to initial introduction of fuel-air mixture and can be employed to provide introduction of air subsequent to initial introduction of fuel-air mixture so as thereby to provide a stratefied charge.

Various arrangements can be employed for introducing air independently of fuel-air mixture. In the illustrated construction, the air introducing means comprises a circumferentially extending auxiliary chamber 51 (See FIG. 5) which is separate from the transfer passages 29, together with means operable in response to cyclical crankcase pressure for providing the chamber 51 with pressurized air, and means for initiating communication of the auxiliary chamber 51 with the combustion chamber 15 after such provision of pressurized air. Thus, in the illustrated construction, the chamber 51 is communicable with the combustion chamber 15 through one or more auxiliary ports 53 (two circumferentially spaced ports in the illustrated construction) which ports 53 have upper edges 55 spaced from the cylinder head end 27 at a distance "C" which is greater than the distance "A", but less than the distance "B" so that the ports 53 are opened in response to piston travel toward bottom dead center after opening of the exhaust port 25 and prior to opening of the transfer ports 31.

Pressurized air is provided in the chamber 51 by introducing atmospheric air into the auxiliary chamber 51 and thereafter pressurizing the air, both in response to cyclical pressure variation in the crankcase 17.

More specifically, the auxiliary chamber 51 is provided with one or more reed valves 59 which open to provide communication with the atmosphere for introduction of air into the auxiliary chamber 51 during conditions of relatively low pressure therein and which close to prevent loss of air from the auxiliary chamber 51 during conditions of relatively high pressure therein.

Figure 6:
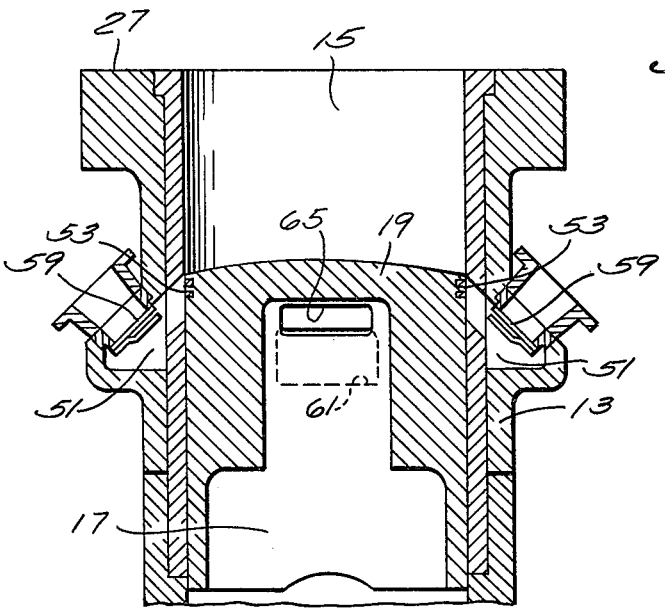
FIG. 6 is a fragmentary cross sectional view similar to FIG. 2 with the piston shown in an intermediate position between top and bottom dead center.

Cyclical crankcase pressure variation is communicated to the auxiliary chamber 51 during each engine cycle by means including (See FIGS. 3 and 6) one or more pressure ports 61 (one in the illustrated construction) which selectively communicate between the auxiliary chamber 51 and the crankcase 17. More specifically, the port 61 communicates with the crankcase 17 when the piston 19 is adjacent to top dead center and when the piston 19 is adjacent to bottom dead center.

Further in this regard, when the piston 19 is adjacent top dead center, i.e., when crankcase pressure is relatively low and the auxiliary ports 53 are closed by the piston 19, the chamber 51 is subject to the relatively low pressure in the crankcase 17, and air is introduced into the chamber 51 through the reed valves 59. Communication between the auxiliary chamber 51 and the crankcase 17 so as to expose the chamber 51 to low pressure condition in the crankcase 17 can be facilitated, if necessary, by one or more ports or downwardly open notches 63 located in the piston skirt 35 so as to register with the port 61.

As the piston 15 moves downwardly from top dead center, the port 61 is closed by the piston skirt 35 and the air introduction into the auxiliary chamber 51 is isolated or trapped. Subsequently, during continued movement of the piston 15 toward bottom dead center and prior to opening of the transfer ports 31 and when the pressure in the crankcase 17 is relatively high, the port 61 comes into initial registry (See FIG. 6) with a piston skirt port 65 which communicates the relatively high pressure in the crankcase 17 with the air in the auxiliary chamber 51. While such communication can take place either before of after opening of the auxiliary ports 53 to the combustion chamber 15, it is preferred that such communication be initiated just prior to opening of the auxiliary ports 53 so that the air in the chamber 51 is pressurized at the time of opening of the auxiliary ports 53. However, regardless of the time of air pressurization, the pressurized air flows into the combustion chamber 15 to scavenge the exhaust gasses prior to entry into the combustion chamber 15 of the fuel-air mixture from the transfer passages 29.

Immediately after the flow of pressurized air into the combustion chamber 15, the transfer passages 29 are opened to permit flow of air-fuel mixture from the crankcase 17 through the transfer passages 29 into the combustion chamber 15 in response to the relatively high pressure in the crankcase 17. In the illustrated construction, it is contemplated that the auxiliary ports 53 will initially open after about fifteen degrees of crankshaft rotation following opening of the exhaust port 25 and that the transfer ports 31 will initially open after about five degrees of crankshaft rotation following initial opening of the auxiliary ports 53.

The invention generally has applicability to spark ignition piston-ported engines, i.e., piston-ported engines other than diesel piston-ported engines.

Various of the features of the invention are set forth in the following claims.

What is claimed is:

1. A method of operating an internal combustion engine which includes a cylinder, a crankcase extending from the cylinder, a piston movable relative to the cylinder and the crankcase so as to cyclically produce in the crankcase conditions of relatively high and low pressure, a transfer passage communicating with the crankcase and communicable with the cylinder in response to piston travel, and an auxiliary chamber separate from the transfer passage, communicable with the cylinder in response to piston travel, and communicable with the crankcase in response to piston travel, said method comprising the steps of supplying a fuel-air mixture to the crankcase during a condition of relatively low pressure in the crankcase, introducing air into the chamber in response to establishing communication between the chamber and the crankcase during a condition of relatively low pressure in the crankcase, thereafter isolating the chamber from the crankcase by discontinuing communication between the chamber and the crankcase, and thereafter pressurizing the air in the chamber in response to establishing communication between the chamber and the crankcase during a condition of relatively high pressure in the crankcase, introducing the fuel-air mixture into the cylinder from the crankcase by establishing communication between the transfer passage and the cylinder during a condition of relatively high pressure in the crankcase, and introducing the pressurized air into the cylinder from the chamber by establishing communication between the chamber and the cylinder such that communication between the cylinder and the chamber is initiated at a time other than the time of initiation of introduction of fuel-air mixture into the cylinder.

2. A method in accordance with claim 1 wherein said step of introducing air into the cylinder from the chamber is initiated before the step of introducing fuel-air mixture into the cylinder is initiated.

3. A method in accordance with claim 1 wherein the step of pressurizing the air occurs prior to initiation of communication between the cylinder and the chamber.

4. A method in accordance with claim 1 wherein the step of pressurizing the air occurs incident to establishing communication through the piston between the crankcase and the chamber.

5. An internal combustion engine comprising a combustion chamber, a crankcase, a piston movable relative to said combustion chamber and said crankcase to effect cyclical pressure variation in said crankcase in response to piston movement, means including a transfer passage for introducing fuel-air mixture into said combustion chamber from said crankcase in response to cyclical crankcase pressure variation, an auxiliary chamber separate from said transfer passage, means for providing said auxiliary chamber with pressurized air in response to cyclical crankcase pressure variation, and means for initiating communication of said auxiliary chamber with said combustion chamber in response to piston movement during the presence of pressurized air in said auxiliary chamber and at a time other than the time of initiation of introduction of fuel-air mixture into said combustion chamber.

6. An internal combustion engine in accordance with claim 5 wherein said means for initiating communication of said auxiliary chamber with said combustion chamber includes means for initiating communication between said combustion chamber and said auxiliary chamber prior to introduction of fuel-air mixture into said combustion chamber.

7. An internal combustion engine in accordance with claim 5 wherein said means for providing said auxiliary chamber with pressurized air comprises means for initially introducing air into said auxiliary chamber and for subsequently pressurizing the air in said auxiliary chamber.

8. An internal combustion engine in accordance with claim 7 wherein said means for introducing and pressurizing air in said auxiliary chamber includes means for selectively communicating said auxiliary chamber with said crankcase.

9. An internal combustion engine in accordance with claim 7 wherein said means for initiating communication of said auxiliary chamber with said combustion chamber includes means for initiating communication between said combustion chamber and said auxiliary chamber prior to introduction of fuel-air mixture into said combustion chamber.

10. An internal combustion engine comprising a cylinder, a crankcase extending from said cylinder, a piston movable relative to said cylinder and said crankcase so as to cyclically produce in said crankcase conditions of relatively high and low pressure, means for supplying a fuel-air mixture to said crankcase during conditions of relatively low pressure therein, a transfer passage communicating between said crankcase aand said cylinder in response to piston movement during conditions of relatively high pressure in said crankcase so as to thereby introduce fuel-air mixture into said cylinder from said crankcase, chamber means separate from said transfer passage, means for introducing air into said chamber means during conditions of relatively low pressure therein, and means operable in response to piston movement for selectively communicating said chamber means with said crankcase and with said cylinder so as to first subject said chamber means to relatively low pressure by communicating said chamber means to said crankcase during a condition of relatively low pressure in said crankcase, to thereafter isolate said chamber means from said crankcase by discontinuing communication between said chamber means and said crankcase, and thereafter to subject said chamber means to relatively high pressure by communicating said chamber means to said crankcase during a condition of relatively high pressure in said crankcase, and to initiate communication of said chamber means with said cylinder when said chamber means is subject to relatively high pressure and at a time other than the time of initiation of introduction of fuel-air mixture into said cylinder from said crankcase.

11. An internal combustion engine in accordance with claim 10 wherein said means for communicating said chamber means with said cylinder includes means for initiating communication between said cylinder and said chamber means prior to introduction of fuel-air mixture into said cylinder.

12. An internal combustion engine in accordance with claim 10 wherein said means for communicating said chamber means with said crankcase during a condition of relatively high pressure in said crankcase comprises a port in said piston providing communication between said crankcase and said chamber means.

13. An internal combustion engine comprising an engine block including a cylinder having a head end, a crankcase extending from the end of said cylinder remote from said head end, an exhaust port communicating with said cylinder and having an upper edge located at a given distance from said cyliner head end, a chamber including a first port communicable with said cylinder and having an upper edge located at a given distance from said cylinder head end greater than the distance from said exhaust port upper edge to said cylinder head end, said chamber also including a second port communicable with said crankcase and including an upper edge located at a given distance from said cylinder head end greater than the distance from said first chamber port upper edge to said cylinder head end, and a transfer passage communicating with said crankcase and including a transfer port communicable with said cylinder and having an upper edge located at a given distance from said cylinder head end greater than the distance from said first chamber port upper edge to said cylinder head end, and a piston including a skirt having therein a port, said piston being reciprocable relative to said cylinder and to said crankcase so as to cyclically produce in said crankcase conditions of relatively high and low pressure, and so as, when said piston is adjacent to said cylinder head end, to close said exhaust port from said cylinder, to close said first chamber port from said cylinder, to close said transfer port from said cylinder, and to open said second chamber port to said crankcase during a condition of relatively low pressure therein, and so as, during piston travel from said cylinder head end, to close said second chamber port from said crankcase and thereby to isolate said chamber from said cylinder and said crankcase, to thereafter open said exhaust port to said cylinder and to communicate said second chamber port through said piston port to said crankcase during a condition of relatively high pressure therein, to thereafter open said first chamber port to said cylinder, and to thereafter open said transfer port to said cylinder so as to communicate said crankcase with said cylinder.

14. A method of operating an internal combustion engine including a cylinder, a crankcase extending from the cylinder, a piston movable relative to the cylinder between top dead center and bottom dead center positions, a source of fuel, a transfer passage communicating with the crankcase and with the cylinder in response to piston travel, a chamber separate from the transfer passage and communicable with the cylinder and with the crankcase in response to piston movement, and a source of fresh air, said method including the steps of supplying fresh air to the chamber from the source of fresh air during piston travel adjacent to top dead center position, thereafter, during piston movement away from top dead center position, isolating the air introduced into the chamber from the cylinder and the crankcase, and subsequently, during further piston movement away from top dead center position, supplying to the cylinder the air in the chamber, and thereafter, during still further piston movement away from top dead center position, supplying fuel to the cylinder through the transfer passage.

15. A method in accordance with claim 14 wherein piston movement relative to the crankcase cyclically produces in the crankcase conditions of relatively high and low pressure, wherein the engine further includes a transfer passage communicable with the crankcase and with the cylinder in response to piston travel, wherein the chamber is separate from the transfer passage and is communicable with the crankcase in response to piston travel, wherein the engine further includes means for supplying fresh air to the chamber in response to conditions of relatively low pressure therein, wherein said method further includes the steps of supplying a fuel-air mixture to the crankcase during conditions therein of relatively low pressure, wherein said step of supplying fresh air to the chamber includes the step of establishing communication between the chamber and the crankcase during conditions therein of relatively low pressure, wherein said step of isolating the air in the chamber includes discontinuing communication between the chamber and the crankcase, wherein said method thereafter further includes the step of pressurizing the air in the chamber in response to establishing communication between the chamber and the crankcase, wherein said method thereafter further includes the step of pressurizing the air in the chamber in response to establishing communication between the chamber and the crankcase during conditions of relatively high pressure in the crankcase, and wherein said step of supplying fuel to the cylinder includes establishing communication between the transfer passage and the cylinder during conditions of relatively high pressure in the crankcase.

16. A method in accordance with claim 15 wherein the step of pressurizing the air occurs prior to initiation of communication between the cylinder and the chamber.

17. A method in accordance with claim 15 wherein said step of pressurizing the air occurs incident to establishing communication through the piston between the crankcase and the chamber.

18. A two-stroke internal combustion engine comprising a cylinder, a crankcase extending from said cylinder, a piston movable relative to said cylinder and said crankcase between top dead center and bottom dead center positions, a transfer passage communicating with said crankcase, a chamber separate from said transfer passage, means for introducing fresh air to said chamber when said piston is adjacent top dead center position, means for isolating the air introduced into said chamber from said cylinder and said crankcase during subsequent piston movement from top dead center position, means for supplying into said cylinder the air introduced into said chamber during further subsequent piston movement from top dead center position, and means for supplying fuel to said cylinder through said transfer passage during still further subsequent movement of said piston from top dead center position.

19. An internal combustion engine in accordance with claim 18 wherein piston movement relative to said crankcase produces cyclical pressure variation in said crankcase, wherein said transfer passage introduces fuel-air mixture into said cylinder from said crankcase in response to cyclical crankcase pressure variation, wherein said means for introducing fresh air to said chamber includes means for supplying said chamber with fresh air and for pressurizing the fresh air in response to cyclical crankcase pressure variation, and wherein said means for supplying into said cylinder the air introduced into said chamber includes means for initiating communication of said chamber with said cylinder in response to piston movement during the presence of pressurized fresh air in said chamber.

20. An internal combustion engine in accordance with claim 18 wherein said means for supplying said chamber with fresh air and for pressurizing such air comprises means for initially introducing air into said chamber and for subsequently pressurizing the air in said chamber.

21. An internal combustion engine in accordance with claim 20 wherein said means for introducing and pressurizing air in said chamber includes means for selectively communicating said chamber with said crankcase.

22. An internal combustion engine in accordance with claim 18 wherein piston movement relative to said crankcase cyclically produces in said crankcase conditions of relatively high and low pressure, wherein said means for supplying fuel to said cylinder includes means for supplying a fuel-air mixture to said crankcase during conditions of relatively low pressure therein, wherein said transfer passage communicates between said crankcase and said cylinder in response to piston movement during conditions of relatively high pressure in said crankcase so as to thereby introduce fuel-air mixture into said cylinder from said crankcase, wherein said means for introducing fresh air into said chamber includes means for supplying fresh air to said chamber in response to the presence therein of relatively low pressure, and means operable in response to piston movement for subjecting said chamber to relatively low pressure by communicating said chamber to said crankcase during conditions of relatively low pressure in said crankcase, wherein said means for isolating the air introduced into said chamber includes means for discontinuing communication between said chamber and said crankcase, and wherein said means for supplying into said cylinder the air introduced into said chamber includes means for subjecting said chamber to relatively high pressure by communicating said chamber to said crankcase during conditions of relatively high pressure in said crankcase, and means for thereafter initiating communication between said chamber and said cylinder.

23. An internal combustion engine in accordance with claim 22 wherein said means for communicating said chamber with said crankcase during conditions of relatively high pressure in said crankcase comprises a port in said piston providing communication between said crankcase and said chamber.

24. An internal combustion engine in accordance with claim 18 wherein said cylinder has a head end, wherein said crankcase extends from the end of said cylinder remote from said head end, wherein said engine further includes an exhaust port communicating with said cylinder and having an upper edge located at a given distance from said cylinder head end, wherein said means for supplying air into said cylinder from said chamber includes a first port communicable between said cylinder and having an upper edge located at a given distance from said cylinder head end greater than the distance from said exhaust port upper edge to said cylinder head end, wherein said means for introducing fresh air to said chamber includes a second port communicable between said crankcase and said chamber and including an upper edge located at a given distance from said cylinder head end greater than the distance from said first chamber port upper edge to said cylinder head end, wherein said transfer passage includes a transfer port communicable with said cylinder and having an upper edge located at a given distance from said cylinder head end greater than the distance from said first chamber port upper edge to said cylinder head end, wherein said piston includes a skirt, and wherein said means for supplying fresh air to said cylinder also includes a port in said skirt communicable with said second chamber port so that reciprocation of said piston relative to said cylinder and to said crankcase cyclically produces in said crankcase conditions of relatively high and low pressure, and so that when said piston is adjacent to said cylinder head end, said exhaust port is closed from said cylinder, said first chamber port is closed from said cylinder, said transfer port is closed from said cylinder, and said second chamber port communicates with said crankcase during conditions of relatively low pressure therein, and so that, during subsequent piston travel from said cylinder head end, said second chamber port is closed from said crankcase so as to isolate said chamber from said cylinder and said crankcase, and so that, during further subsequent piston travel, said exhaust port is open to said cylinder and said second chamber port communicates through said piston port to said crankcase during conditions of relatively high pressure therein, and so that, during still further subsequent piston travel from said head end, said first chanber port is open to said cylinder, and so that, during still further subsequent piston travel from said head end, said transfer port is open to said cylinder.

25. A method of operating an internal combustion engine including a cylinder, a crankcase extending from the cylinder, a piston movable relative to the cylinder between top dead center and bottom dead center positions so as to cylindrically produce in the crankcase conditions of relatively high and low pressure, a transfer passage communicating with the crankcase and with the cylinder in response to piston travel, a source of fuel, a chamber separate from the transfer passage and communicable with the cylinder and with the crankcase in response to piston movement, and means for supplying fresh air to the chamber in response to conditions of relatively low pressure therein, said method including the steps of supplying fresh air to the chamber during piston travel adjacent to top dead center position and in response to establishing communication with the crankcase during relatively low pressure conditions therein, thereafter, during piston movement away from top dead center position, isolating the air introduced into the chamber from the cylinder and the crankcase, and subsequently, during further piston movement away from top dead center position, establishing communication between the chamber and each of the cylinder and the crankcase during conditions of relatively high pressure in the crankcase so as to supply to the cylinder the air in the chamber, and thereafter, during still further piston movement away from top dead center position, supplying fuel to the cylinder through the transfer passage.

26. A method in accordance with claim 25, and wherein said method further includes the steps of supplying a fuel-air mixture to the crankcase during conditions therein of relatively low pressure, wherein said step of isolating the air in the chamber includes discontinuing communication between the chamber and the crankcase, wherein said method thereafter further includes the step of pressurizing the air in the chamber in response to establishing communication between the chamber and the crankcase during conditions of relatively high pressure in the crankcase, and wherein said step of supplying fuel to the cylinder includes establishing communication between the transfer passage and the cylinder during conditions of relatively high pressure in the crankcase.

27. A method in accordance with claim 26 wherein the step of pressurizing the air occurs prior to initiation of communication between the cylinder and the chamber.

28. A method in accordance with claim 26 wherein said step of pressurizing the air occurs incident to establishing communication through the piston between the crankcase and the chamber.

29. A two-stroke internal combustion engine comprising a cylinder, a crankcase extending from said cylinder, a piston movable relative to said cylinder and said crankcase between top dead center and bottom dead center positions so as to cyclically produce in said crankcase conditions of relatively high and low pressure, a transfer passage communicating with said crankcase, a chamber separate from said transfer passage, means for introducing fresh air to said chamber in response to the presence in said chamber of low pressure conditions, means for establishing communication between said chamber and said crankcase when said piston is adjacent top dead center position and said crankcase is subject to low pressure conditions and so as thereby to introduce air into said chamber, means for isolating the air introduced into said chamber from said cylinder and said crankcase during subsequent piston movement from top dead center position, means for establishing communication between said chamber and each of said cylinder and said crankcase so as to supply into said cylinder the air introduced into said chamber during further subsequent piston movement from top dead center position, and means for supplying fuel to said cylinder through said transfer passage during still further subsequent movement of said piston from top dead center position.

30. An internal combustion engine in accordance with claim 29 wherein said transfer passage introduces fuel-air mixture into said cylinder from said crankcase in response to cyclical crankcase pressure variation.

31. An internal combustion engine in accordance with claim 29 wherein said transfer passage communicates between said crankcase and said cylinder in response to piston movement during conditions of relatively high pressure in said crankcase so as to thereby introduce fuel-air mixture into said cylinder from said crankcase, wherein said means for isolating the air introduced into said chamber includes means for discontinuing communication between said chamber and said crankcase, and wherein said means for supplying into said cylinder the air introduced into said chamber includes means for subjecting said chamber to relatively high pressure by communicating said chamber to said crankcase during conditions of relatively high pressure in said crankcase, and means for thereafter initiating communication between said chamber and said cylinder.

32. An internal combustion engine in accordance with claim 31 wherein said means for communicating said chamber with said crankcase during conditions of relatively high pressure in said crankcase comprises a port in said piston providing communicating between said crankcase and said chamber.

33. An internal combustion engine in accordance with claim 29 wherein said cylinder has a head end, wherein said crankcase extends from the end of said cylinder remote from said head end, wherein said engine further includes an exhaust port communicating with said cylinder and having an upper edge located at a given distance from said cylinder head end, wherein said means for supplying air into said cylinder from said chamber includes a first port communicable with said cylinder and having an upper edge located at a given distance from said cylinder head end greater than the distance from said exhaust port upper edge to said cylinder head end, wherein said means for introducing fresh air to said chamber includes a second port communicable between said crankcase and said chamber and including an upper edge located at a given distance from said cylinder head end greater than the distance from said first chamber port upper edge to said cylinder head end, wherein said transfer passage includes a transfer port communicable with said cylinder and having an upper edge located at a given distance from said cylinder head end greater than the distance from said first chamber port upper edge to said cylinder head end, wherein said piston includes a skirt, and wherein said means for supplying air to said cylinder also includes a port in said skirt communicable with said second chamber port so that when said piston is adjacent to said cylinder head end, said exhaust port is closed from said cylinder, said first chamber port is closed from said cylinder, said transfer port is closed from said cylinder, and said second chamber port communicates with said crankcase during conditions of relatively low pressure therein, and so that, during subsequent piston travel from said cylinder head end, said second chamber port is closed from said crankcase so as to isolate said chamber from said cylinder and said crankcase, and so that, during further subsequent piston travel, said exhaust port is open to said cylinder and said second chamber port communicates through said piston port to said crankcase during conditions of relatively high pressure therein, and so that, during still further subsequent piston travel from said head end, said first chamber port is open to said cylinder, and so that, during still further subsequent piston travel from said head end, said transfer port is open to said cylinder.

* * * * *

UNITED STATES PATENT OFFICE

CERTIFICATE OF CORRECTION

Patent No. 4,026,254 Dated May 31, 1977

Inventor(s) Dr. Josef Ehrlich

It is certified that error appears in the above-identified patent and that said Letters Patent are hereby corrected as shown below:

| | |
|---|---|
| Column 3, line 13 | before the word "port" insert ---exhaust---. |
| Column 9, lines 45-50 | Delete the following: "wherein the engine further includes a transfer passage communicable with the crankcase and with the cylinder in response to piston travel, wherein the chamber is separate from the transfer passage and is communicable with the crankcase in response to piston travel,". |
| Column 12, line 36 | delete "and". |

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*

UNITED STATES PATENT OFFICE

CERTIFICATE OF CORRECTION

Patent No. 4,026,254 Dated May 31, 1977

Inventor(s) Dr. Josef Ehrlich

It is certified that error appears in the above-identified patent and that said Letters Patent are hereby corrected as shown below:

| | |
|---|---|
| Column 12, line 11 | delete "cylindrically", insert ---cyclically---. |
| Column 13, line 42 | delete "communicating", insert ---communication---. |

Signed and Sealed this

Ninth Day of May 1978

[SEAL]

Attest:

RUTH C. MASON
Attesting Officer

LUTRELLE F. PARKER
Acting Commissioner of Patents and Trademarks